US005554074A

United States Patent [19]

Von Parrish

[11] Patent Number: 5,554,074

[45] Date of Patent: Sep. 10, 1996

[54] PLAYGROUND DECK ASSEMBLY

[75] Inventor: Terry Von Parrish, Monett, Mo.

[73] Assignee: Miracle Recreation Equipment Company, Monett, Mo.

[21] Appl. No.: 136,590

[22] Filed: Oct. 14, 1993

[51] Int. Cl.[6] ..... A63G 21/00

[52] U.S. Cl. ..... 472/116; 52/309.12; 52/79.1; 52/737.2; 482/35; 482/37

[58] Field of Search ..... 472/116; 482/35, 482/36, 37; 52/79.1, 79.4, 309.7, 721, 282

[56] References Cited

U.S. PATENT DOCUMENTS

| | | | |
|---|---|---|---|
| D. 238,694 | 2/1976 | Jamison | 472/116 X |
| 3,633,325 | 1/1972 | Bartoli | 52/79.1 X |
| 3,969,871 | 7/1976 | Ewers | 52/721 |
| 4,078,348 | 3/1978 | Rothman | 52/309.7 |
| 4,484,738 | 11/1984 | Ahrens et al. | 52/282 X |
| 5,117,596 | 6/1992 | Leslie et al. | 52/79.4 X |

*Primary Examiner*—Carl D. Friedman
*Assistant Examiner*—W. Glenn Edwards
*Attorney, Agent, or Firm*—Zarley, McKee, Thomte, Voorhees & Sease

[57] ABSTRACT

A playground deck is supported above the ground on a center pedestal through radially extending cantilevered arms connected to plates on the exterior of the pedestal and to each other through a ring disposed at the axial center of the pedestal thereby providing an integral support frame for pie shaped deck sections which include hollow plastic shells filled with plastic foam. The support arms have bottom and intermediate ledges on opposite sides which engage the pie sections for support and structural strength. A rounded nose portion may be connected to each of the pie sections at their outer ends to give the deck a circular shape. A plate interconnects the outer ends of the arms and the nose portions to the pie sections to rigidify the support framework. A web climber may be connected to the deck and includes a grid work of horizontal and vertical cables locked together at junctions by locking blocks which clamp the cables against each other. The blocks are enclosed in circular half sections to give an enlarged button appearance at each cable intersection and function as hand holds and steps for users. A hand ring bridge may be connected to the deck and includes a series of spaced apart rings which are limited to only transverse pivotal movement thereby assuring proper positioning when used. A bumper ladder may be connected to the deck and includes a series of spools on a vertical support rod, cable, or combination thereof depending on the climbing challenge desired. Spools include mirror image top and bottom ends which slope outwardly to an enlarged annular shoulder from top and bottom annular smaller end shoulders which function as hand holds and foot rests.

31 Claims, 15 Drawing Sheets

212
206
210
204
200
202
188
186
202
198
208

PLAYGROUND DECK ASSEMBLY

BACKGROUND OF THE INVENTION

Typical playground equipment involves a deck made of metal supported on four posts. Various activity in units may be connected to the deck and they also would have metal surfaces on which the children would play. Metal, while having many good qualities, is nevertheless, hard and not user-friendly due to its lack of energy absorption.

Thus, what is needed is a playground deck assembly utilizing a metal frame on which energy absorbing but structurally strong non-metal flooring is supported.

SUMMARY OF THE INVENTION

The playground deck assembly of this invention includes a deck solely supported by a center pedestal from which support arms are cantilevered. Pie shaped deck sections are placed on the support arms. Each of the deck sections and sections used as steps in stairways and tread panels in bridges are made of plastic. The sections include shells formed through rotational molding using low linear polyethylene plastic. The shells are then filled with a two component polyurethane foam having two pounds/cubic foot density. These sections are structurally strong but yet energy absorbing and thus, unlikely to injure children playing on them.

The cantilevered arms are connected at their inner ends to plates on the outer wall of the pedestal and then to each other through a ring positioned in the center of the pedestal thus providing a unitary support framework on which the pie sections are placed. The outer ends of the pie sections are straight but are finished with nose portions having a rounded outer surface giving the entire deck a circular shape. A connecting plate between the nose portions and the outer ends of the pie sections interconnects adjacent arms to give the entire deck framework added strength by making it a unitary support structure. The pie sections are supported on their bottom sides as well as along their side edges intermediate their top and bottom surfaces. Each arm has on opposite sides bottom ledges engaging the bottom side of the pie section and intermediately spaced ledges for engaging shoulders formed in the pie sections midway between the top and bottom surfaces.

The connecting plate between adjacent arms can also be used to connect stairs, bridges, and other accessories to the deck at any desired pie section in lieu of the nose portion which would otherwise be installed.

The outer ends of the support arms include post holders which receive posts for providing an enclosure around the deck or connecting enclosure panels used in bridges, stairs, and the like. A pair of enclosure panels each including upper and lower rails have free ends that extend into the post and are locked to the post by a totally internally positioned lock assembly comprising upper and lower lock rings. The top lock ring engages the top side of the top rails and the bottom ring engages the bottom side of the lower rails. The lock rings are drawn together by an adjustable bolt accessible from the top of the post which has a removable cap. A pin may be dropped through the top lock ring into openings into the top rail end portions thereby preventing the enclosure panels from inadvertently being separated from the post. Alignment problems in connecting the panels together or to other equipment are minimized by ease of positioning the top and bottom rail ends into the post as far as needed. A stop is provided on the lock rings to limit their rotation when the adjustment bolt is being tightened.

Children that are physically restricted are provided an access platform which is appropriately spaced above the ground and connects to stairs leading to the ground and to the deck. An access opening to the transfer platform is defined by a pair of vertical members on opposite sides of the platform which are interconnected at their top ends by a conventional railing usable by children standing on the platform. A second horizontal rail is positioned below the top railing centrally over the access opening and connects with assist bars at opposite ends which extend downwardly and outwardly to the vertical side members. A child can reach these assist bars and the lower rail for providing assistance in moving onto the transfer platform.

One of the activity units connected to the deck is a web climber which has a grid of cables extending horizontally and vertically to the ground where they are anchored. The cables at each intersection are locked together by a pair of locking blocks interconnected by bolts which compress the cables against each other thereby limiting movement there between. The locking blocks are enclosed by a circular outer shell comprised of two half sections bolted together giving the web the appearance of having enlarged buttons at each intersection. The enlarged buttons are used as hand holds and foot steps in ascending or descending the web climber.

Another activity unit that may be attached to the deck is a hand ring bridge where the hand rings are D shaped and are pivotly connected to hanger assemblies which allow them to pivot only transversely of the support rail. This arrangement assures that the rings remain in the proper position for grabbing ahold of as the child moves from one ring to the next.

A bumper ladder may be connected to the deck and includes a support stand on the deck which has an upper portion extending upwardly and outwardly and then downwardly to which a support member extends to the ground. The support member extends through a series of spools which are positioned in end to end relationship. The support member may be a rigid pole or a flexible cable or a combination of both depending on the challenge to the user that is desired. The individual spools have mirror image top and bottom ends which slope outwardly to a midsection annular shoulder. Smaller annular shoulders are also provided at the top and bottom ends and function as hand holds or foot rests.

The deck, bridge, or stairs may have enclosure panels which include upper and lower rails connected at their outer ends to posts. Between the posts are vertical rod members connected to the upper and lower rails through clamp assemblies which include a U shape hanger extending around the rail and embracing the flattened end of the rod member. A bolt extending through the legs of the hanger and the end of the rod member allows for pivotal movement thereby permitting connection to rails extending at different angles to the rod members such as on stairs. The clamp assembly is enclosed within a pair of semi-spherical half-sections which when assembled give the appearance of balls at the top and bottom ends of the rods where they are connected to the upper and lower rails.

DESCRIPTION OF PREFERRED EMBODIMENT

Figure 1:
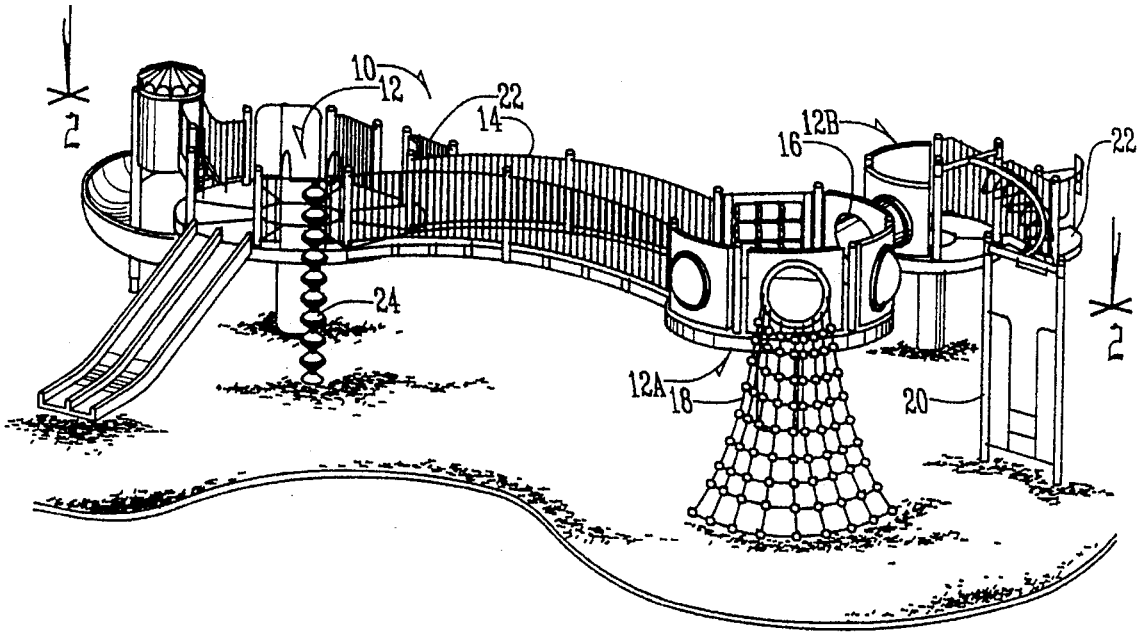
FIG. 1 is perspective view of the playground deck assembly of this invention.
Figure 2:
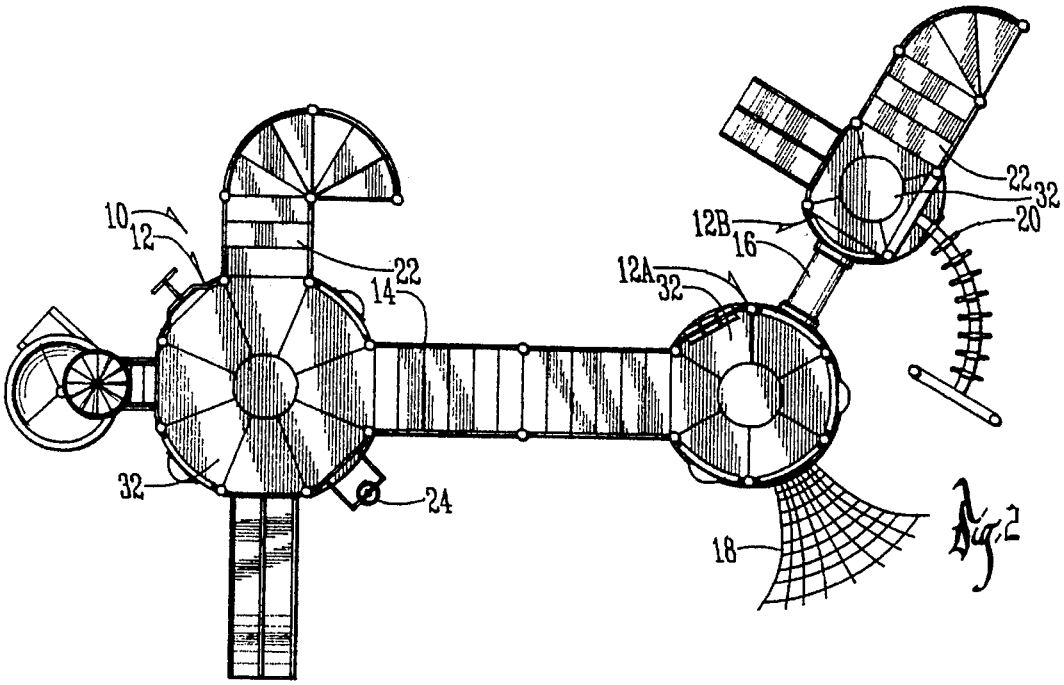
FIG. 2 is a top plan view thereof.
Figures 3, 4, 5:
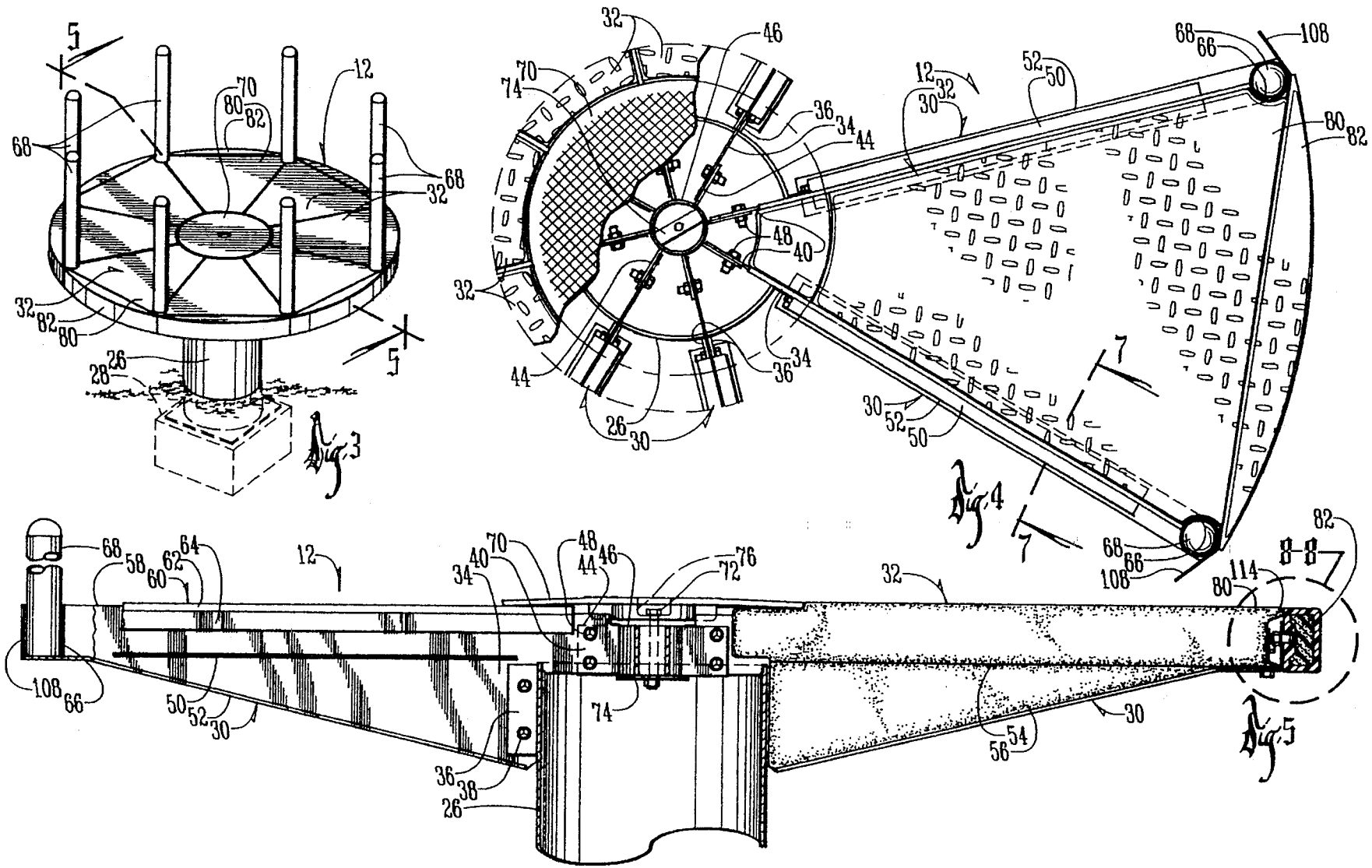
FIG. 3 is a fragmentary enlarged perspective view of the playground deck.
FIG. 4 is a fragmentary top plan view of the center support pedestal and two support arms on which a pie shaped deck section is placed having an outer rounded nose portion.
FIG. 5 is a cross sectional view taken along line 5—5 in FIG. 3.

The playground deck assembly is referred to generally by the reference numeral 10 and is seen in FIGS. 1–3 to include an large deck 12 connected through a bridge 14 to an intermediate size deck 12A in turn connected through a tube 16 to a smaller deck 12B. Some of the activity units connected to the decks which will be discussed in more detail later include a web climber 18, hand ring bridge 20, transfer platform 22, and bumper ladder 24.

The deck 12 as seen best in FIG. 3–8 includes a center pedestal 26 bolted to a concrete slab 28. The pedestal supports a plurality of cantilevered arms 30 which in turn support pie shaped deck sections 32. The arms 30 have lower inner end portions 34 which are received between a pair of plates 36 and secured together by bolts 38. An upper projection portion 40 is bolted to a radially extending plate 44 on a ring 46 positioned in the axial center of the pedestal 26 and secured by bolts 48 to provide a unified rigid frame assembly for the pie shaped deck sections 32.

Figure 7:
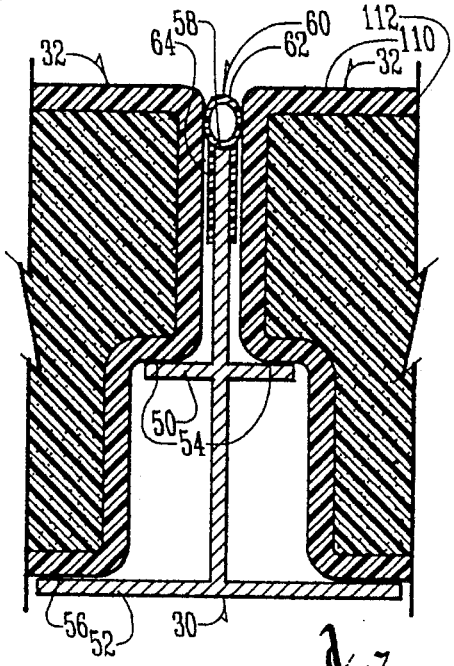
FIG. 7 is a cross sectional view taken along line 7—7 in FIG. 4.

Each of the support arms 30 include on opposite sides an upper support ledge 50 and a lower support ledge 52 for engagement with the pie shaped deck section 32. The ledge 50 is positioned intermediate the top and bottom edges of the arm 30 and engages a shoulder 54 formed in the side of the pie section 32 as seen in FIG. 7. The lower ledge 52 engages the bottom side 56 of the pie section 32 and is inset therein to present a smooth surface along the bottom side of the deck. The top edge 58 of the arm 30 is covered with a filler extrusion 60 which includes a tubular head element 62 connected to downwardly extending legs 64 disposed on opposite sides of the top edge 58 of the arm 30.

A post holder sleeve 66 is provided at the outer end of each arm 30 and receives a post 68.

A cover plate 70 is placed over the ring 46 in the open upper end of the pedestal 26 and is secured there by a bolt 72 which extends through the ring 46 and into a threaded plate 74 welded to the bottom end of the ring 46. A cap 76 is placed in an opening 78 in cover plate 70 which gives access to the bolt 72.

The outer ends 80 of the pie shaped deck sections 32 are straight but they have attached to them nose portions 82 having an outer rounded edge which gives the entire deck a circular shape in appearance. A first L shaped plate 84 includes a vertical leg section 86 and horizontal leg 88. The vertical leg has a downwardly and outwardly extending diagonal portion 90 which connects to the horizontal leg 88. Bolts 92 connect the plate 84 to T nuts 94 molded into the outer edge of the pie section 32. A second L shaped plate 96 has a vertical leg 98 and a horizontal leg 100. Bolts 102 connect the plate 96 to T nuts 104 molded into the nose portion 82. Pop rivets 106 then interconnect the horizontal legs 88 and 100. The outer ends of the vertical legs 98 of the plate 96 are bolted to a bracket 108 which functions to rigidly interconnect the outer ends of adjacent arms 32 to further strengthen the deck framework.

The pie shaped deck section 32 includes an outer low linear polyethylene shell 110 which is filled with two component polyurethane foam 112 having a density of two pounds per cubic foot. The outer nose portion 82 also has this same construction as do all other stair steps and bridge tread sections.

Figure 8:
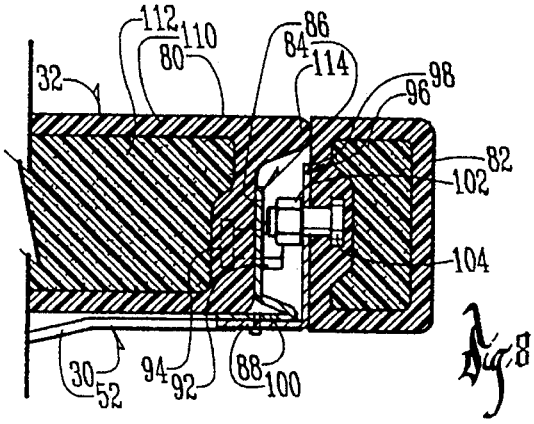
FIG. 8 is an enlarged cross sectional view as indicated by line 8—8 in FIG. 5 of the connection between the outer rounded nose portion to the outer end of the pie shaped deck section.

It is seen in FIG. 8 that a shoulder 114 is provided on the top outer edge of the pie sections 32 and abuts against the inner face of the nose portion 82 thereby obscuring from the top the plates 84 and 96 and related fasteners.

Figure 6:
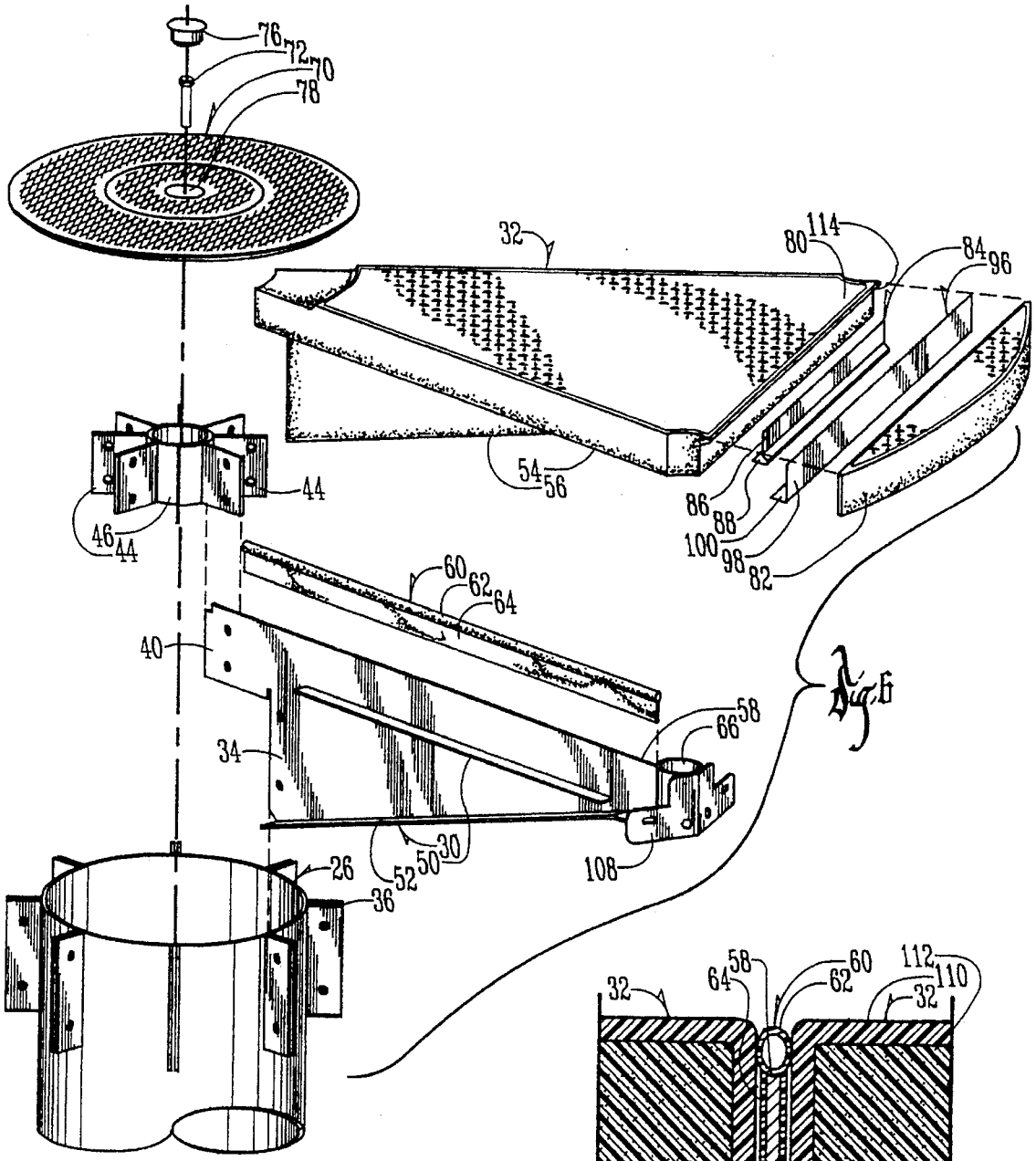
FIG. 6 is an exploded fragmentary view of the support arms and pie sections connected to the center pedestal.
Figure 12:
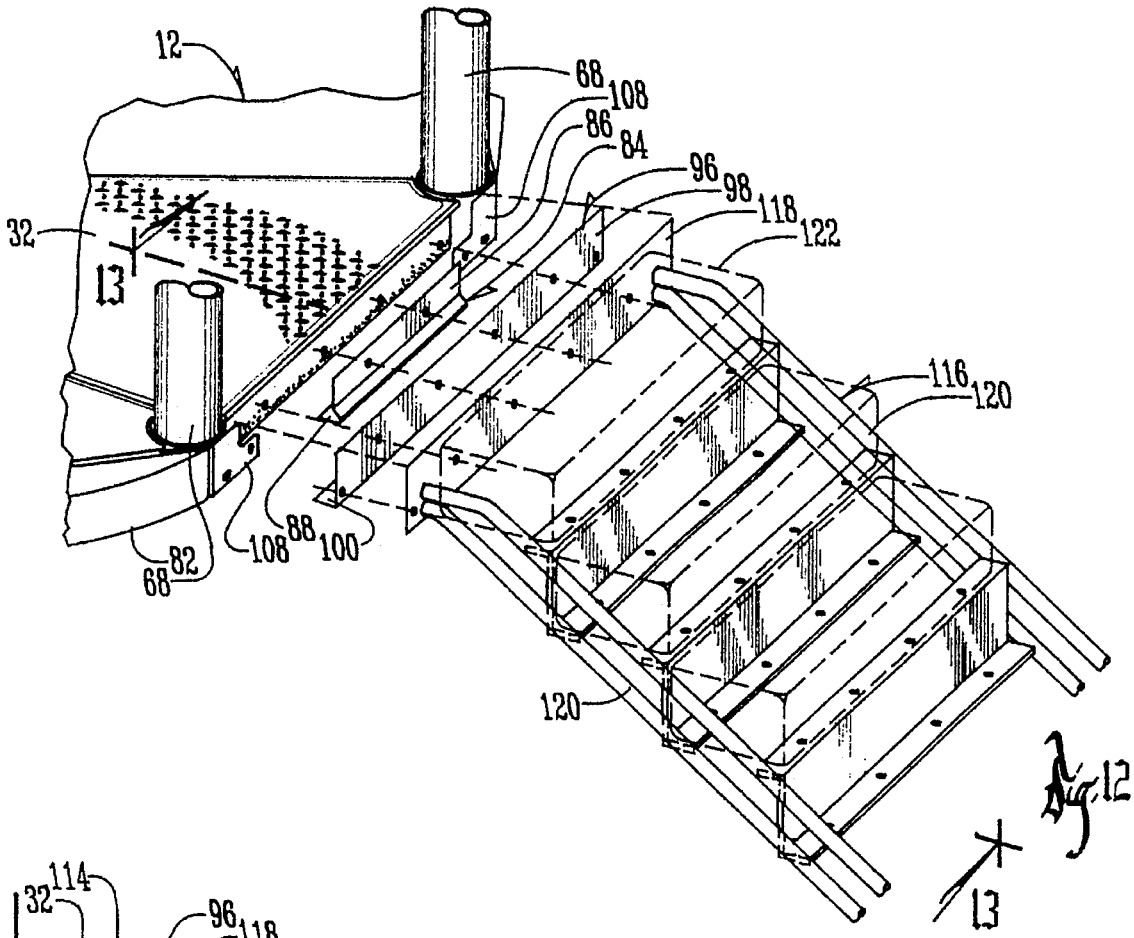
FIG. 12 is a fragmentary perspective view of steps connected to the deck at the outer end of a pie section.
Figure 13:
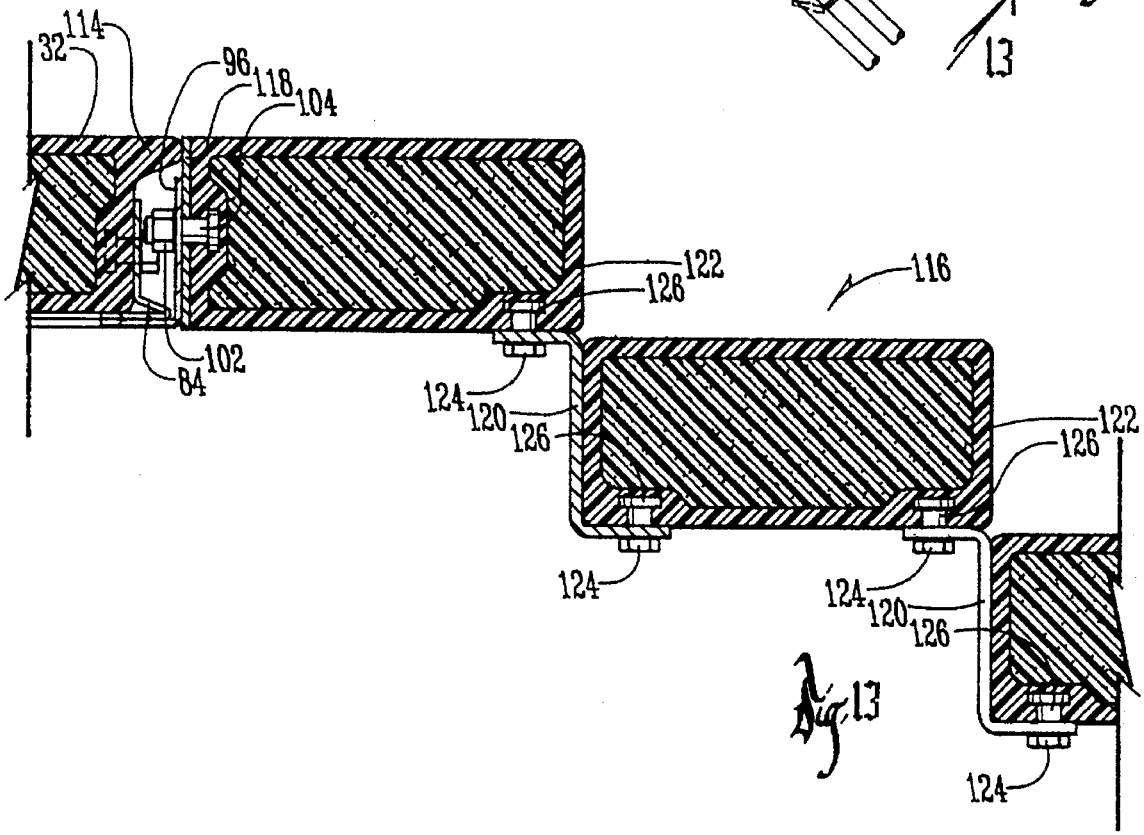
FIG. 13 is a cross sectional view along line 13—13 in FIG. 12.
Figure 14:
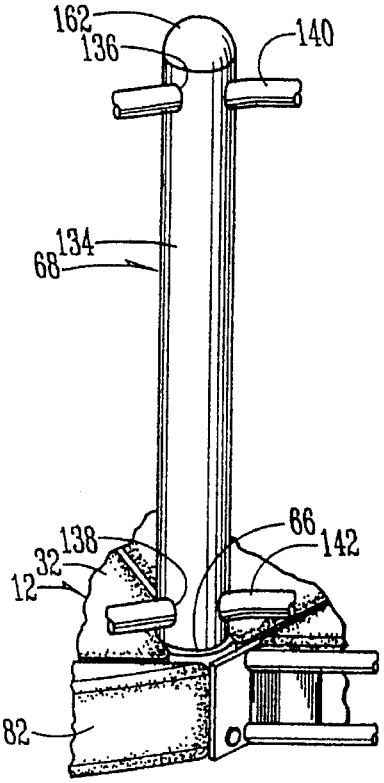
FIG. 14 is a fragmentary perspective view of a post at the outer end of a support arm on the deck.
Figure 15:
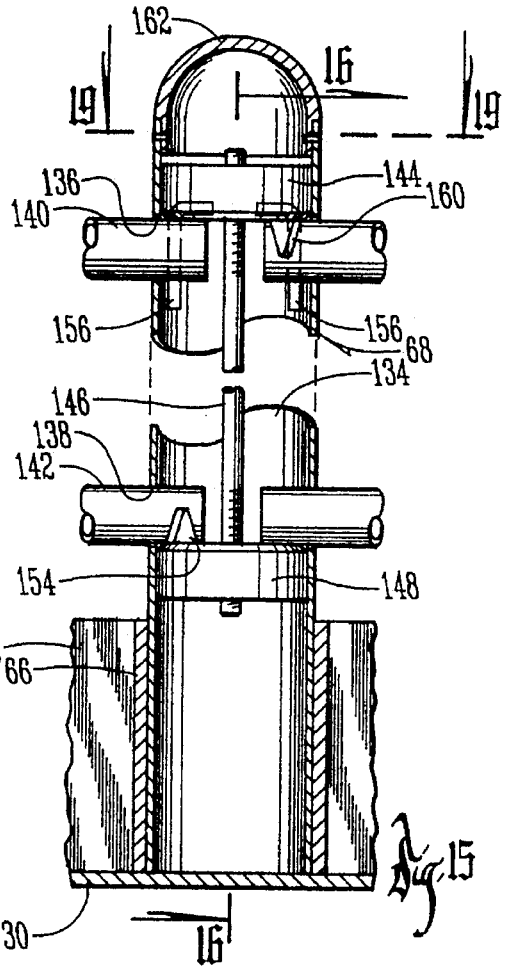
FIG. 15 is an enlarged elevational cross sectional view of the post.

A stairs 116 is seen in FIGS. 12 and 13 having a face plate 118 which is bolted to the L shaped plate 96 which in turn is riveted to the L shaped plate 84 and bolted to the brackets 108 in the same manner as the nose portion 82 is fastened to the deck 32 as seen in FIGS. 6 and 8.

The stairs 116 include a frame 120 connected to the face plate 118 and further include individual steps 122 which are bolted in place by bolts 124 screwed into T nuts 126 molded into the steps. Steps 122 are of the same construction as the pie shaped deck sections 32.

Figure 9:
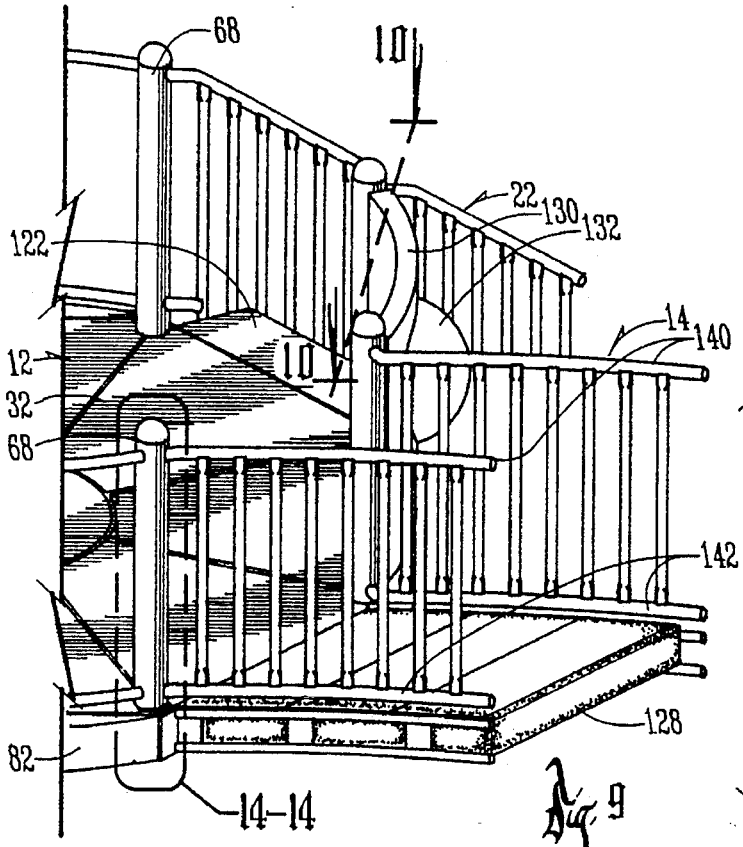
FIG. 9 is a fragmentary perspective view of a bridge connected to the playground deck.
Figure 10:
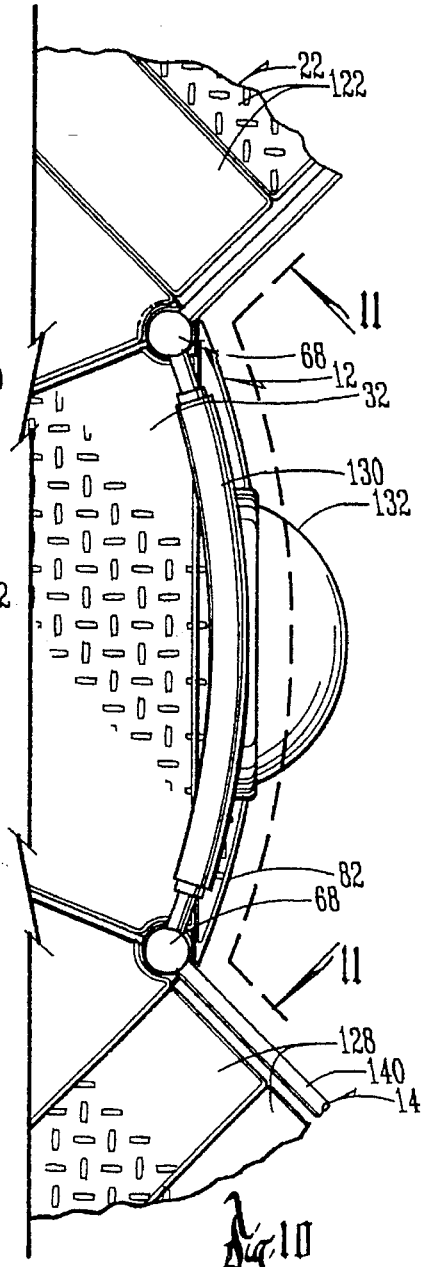
FIG. 10 is a fragmentary top plan view taken along line 10—10 in FIG. 9.
Figure 11:
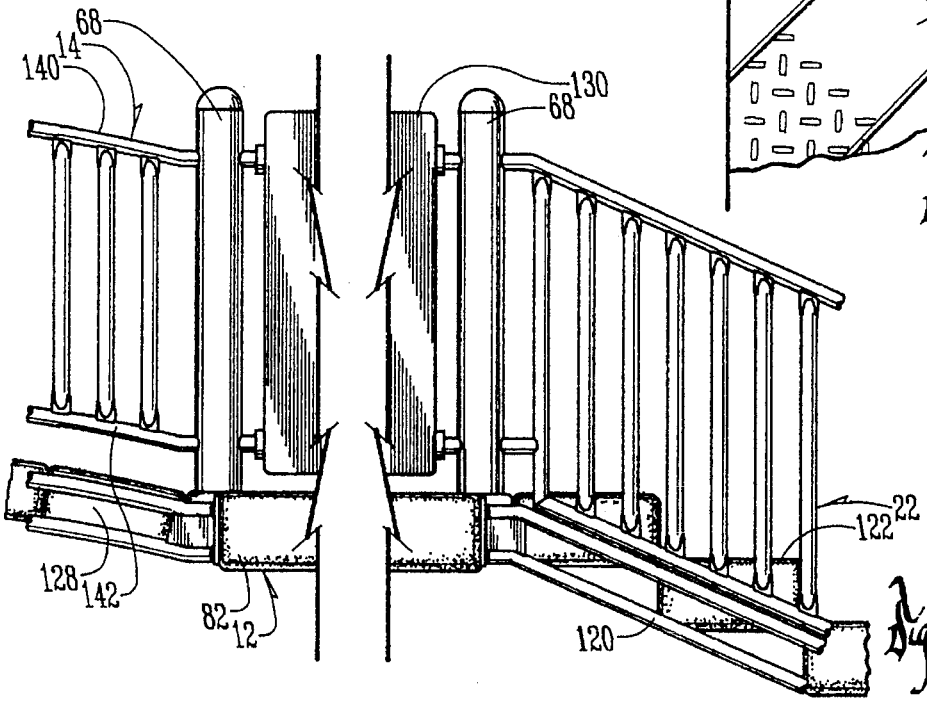
FIG. 11 is a fragmentary side elevational view of the bridge connected to stairs taken along line 11—11 in FIG. 9.

The bridge 14 in FIG. 9 includes tread panels 128 of the same construction as the pie shaped deck sections 32 as indicated by lines 14—14 in FIG. 9. The panel 130 on the deck 12 includes a bubble 132. The panel 130 is connected to the platform 12 through spaced apart posts 68.

Figure 16:
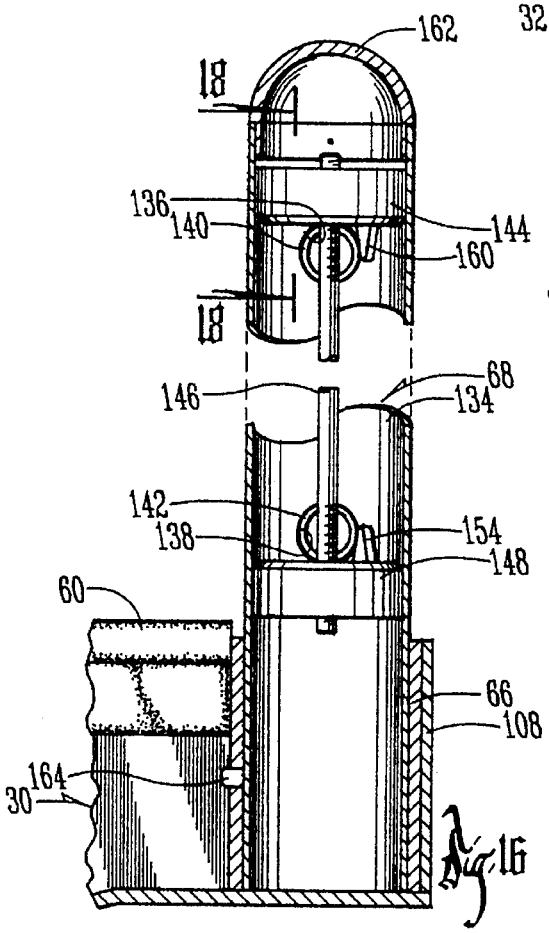
FIG. 16 is a cross sectional view taken along line 16—16 in FIG. 15.
Figure 17:
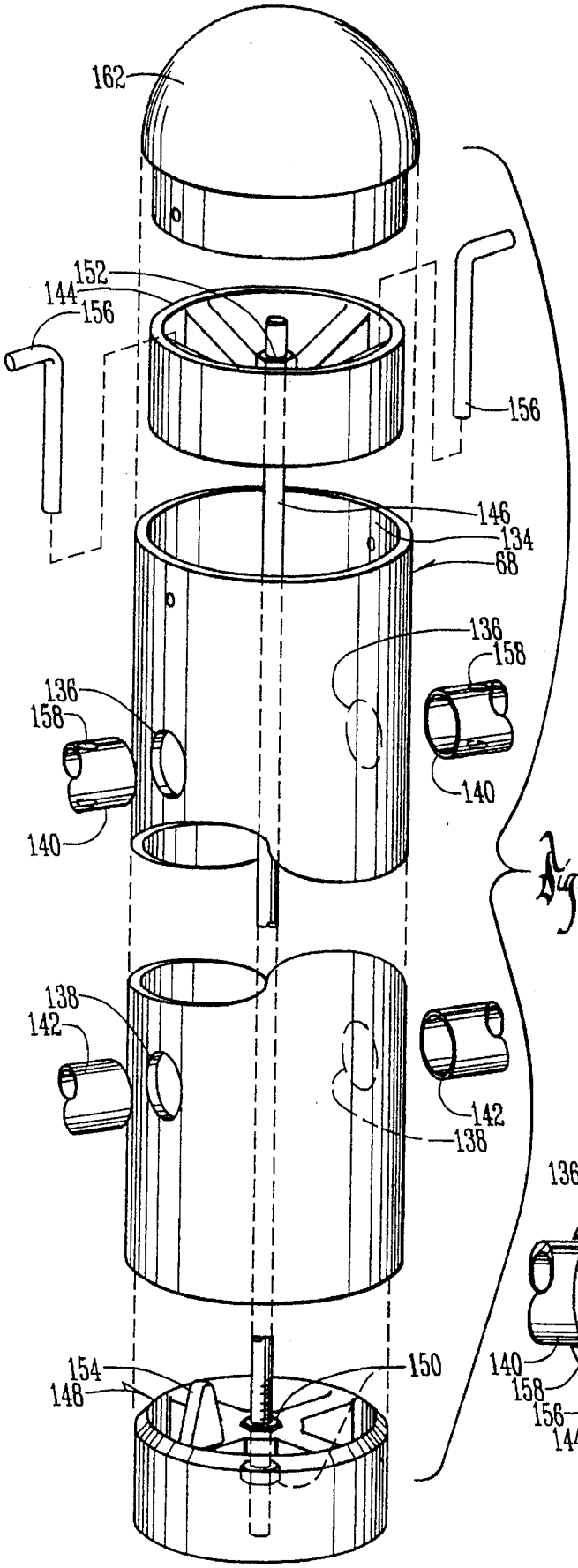
FIG. 17 is an exploded fragmentary view of the post and the internal lock rings for securing the upper and lower rail ends to the post.
Figure 18:
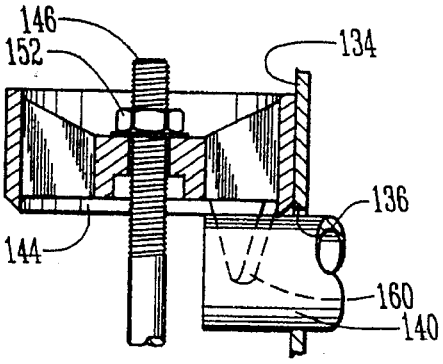
FIG. 18 is a cross sectional view taken along line 18—18 in FIG. 16.
Figure 19:
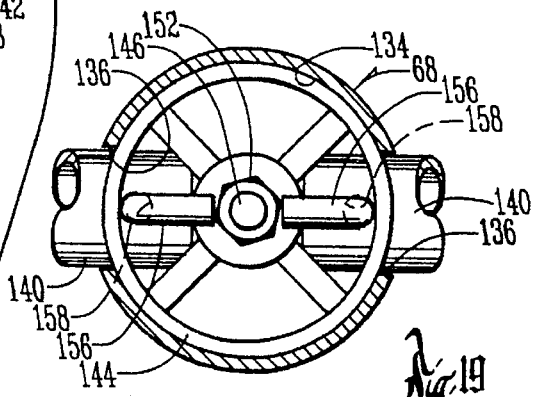
FIG. 19 is a cross sectional view taken along line 19—19 in FIG. 15.

The posts 68 are shown in detail in FIGS. 14–19 and include a hollow tube 134 having oppositely disposed upper openings 136 and lower openings 138 which receive upper railing ends 140 and lower ends 142 respectively. A lock assembly is provided inside the hollow tube 134 and includes an upper lock ring 144 connected by a bolt 146 to a lower lock ring 148. The lower lock ring 148 includes top and bottom nuts 150 for securely fastening the lock ring to the bolt. An adjustment nut 152 on the bolt above the upper lock ring 144 allows for drawing the lock rings 144 and 148 together against the top side of the top rail ends 140 and the bottom side of the lower rail ends 142 thereby pressing them against the edges of the openings 136 and 137 respectively to hold them in a locked relationship to the post 68. A triangular shaped stop 154 on the lower lock ring 148 is positioned to engage a railing end 142 to prevent rotation of the lock ring. L shaped pins 156 are positioned through the upper lock ring 144 and are received in holes 158 in the upper railing in portions 140 to prevent inadvertent withdrawal of the end portions from the tube 134. As seen in FIG. 18 a downwardly extending triangular shaped stop element 160 engages the railing end portion 140 to prevent rotation of the lock ring 144. A cap 162 is telescopicaly received into the top open end of the tube 134 to make the lock ring assembly totally inaccessible or viewable. The post 68 is locked to the post holder sleeve 66 by a set screw 164 as seen in FIG. 16.

Figure 20:
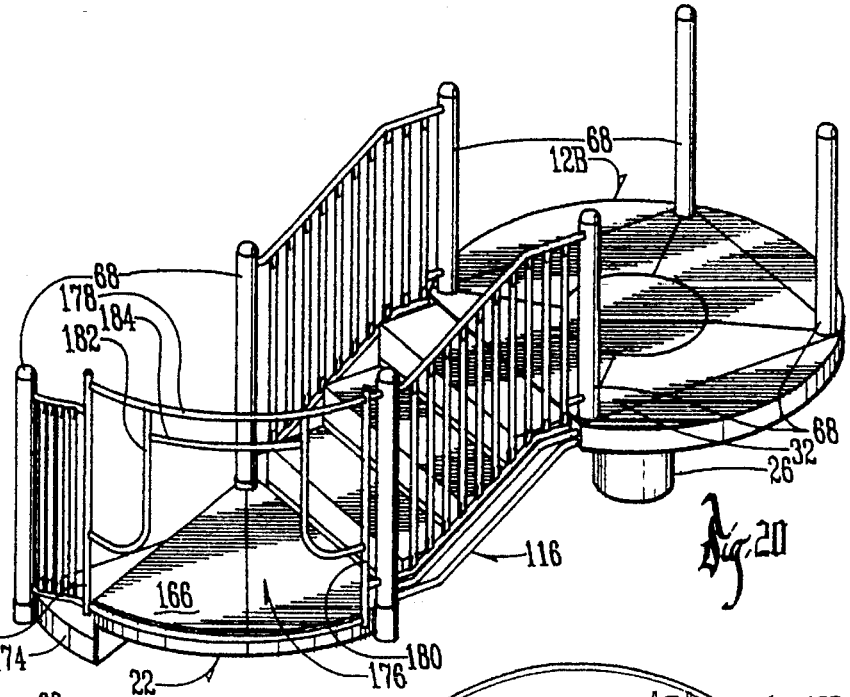
FIG. 20 is a fragmentary perspective view of the deck to which stairs descend to a transfer platform in turn connected to stairs leading to the ground.
Figure 21:
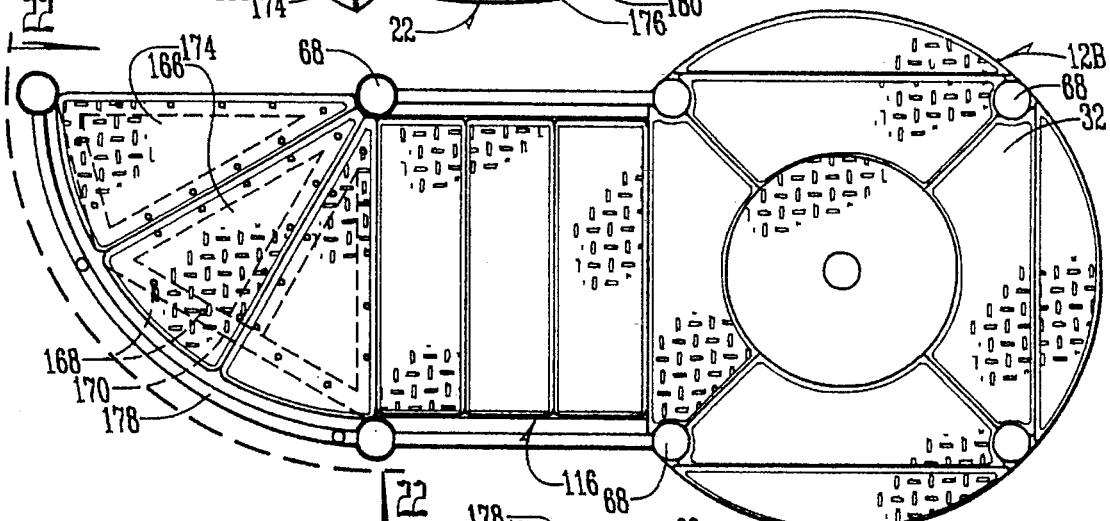
FIG. 21 is a top plan view thereof.
Figure 22:
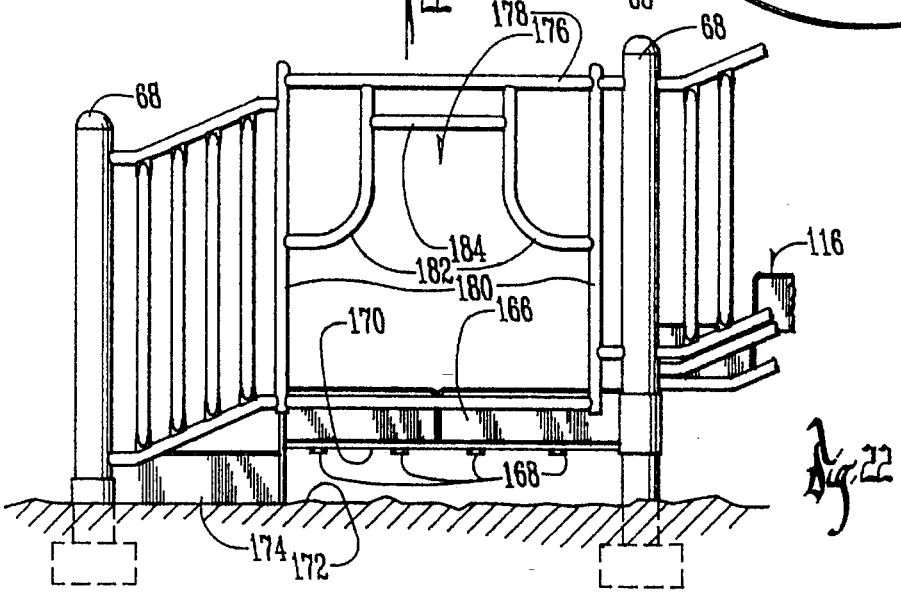
FIG. 22 is a fragmentary side elevational view taken along line 22—22 in FIG. 21.
Figure 23:
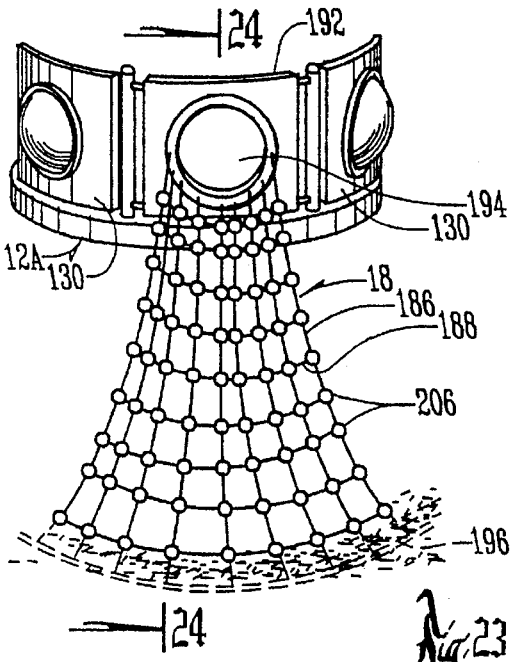
FIG. 23 is an elevational view of a web climber connected to the deck.
Figure 24:
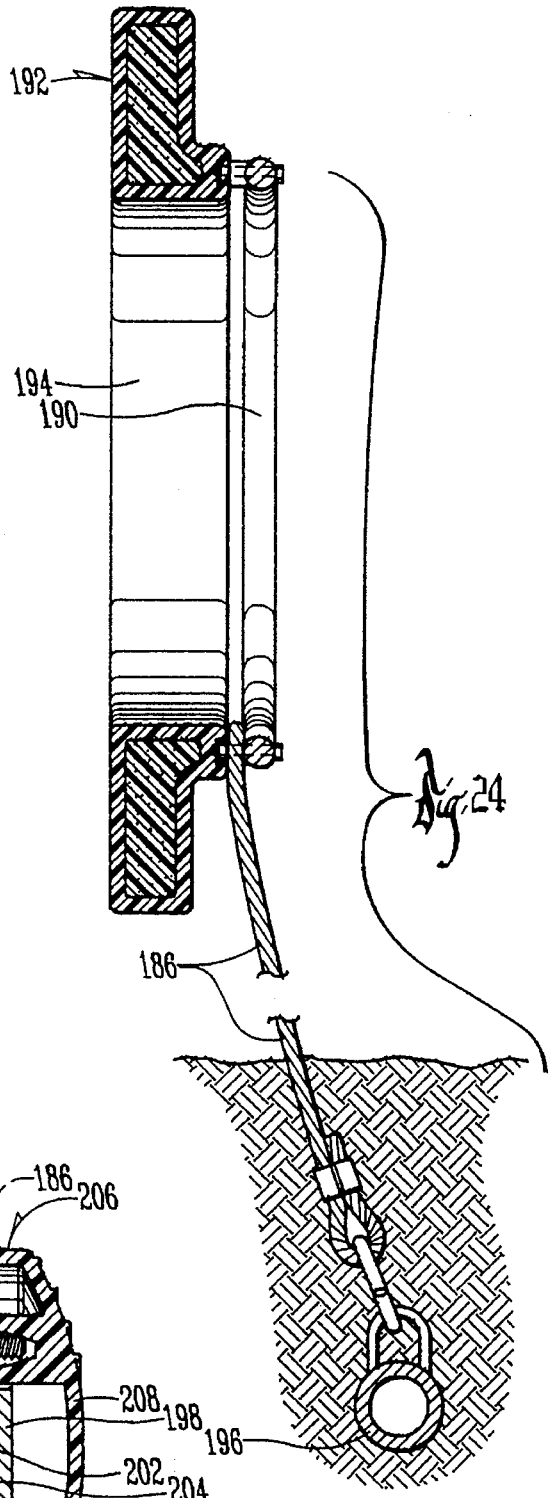
FIG. 24 is a cross sectional view taken along line 24—24 in FIG. 23.
Figure 25:
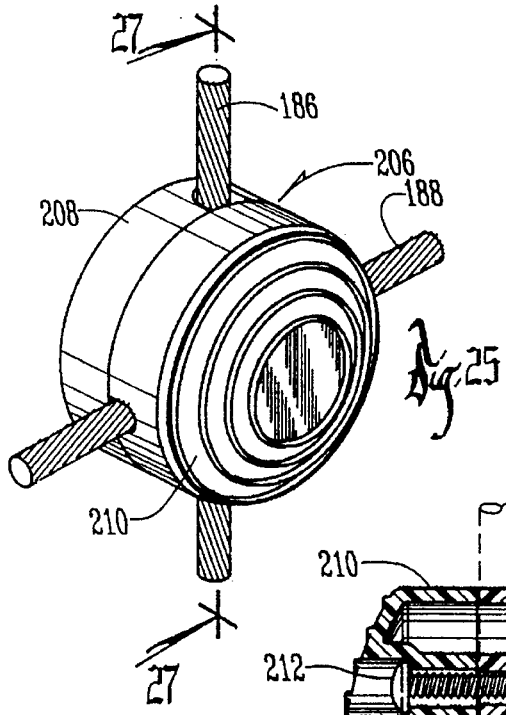
FIG. 25 is a fragmentary perspective view of the cylindrical enclosures for the locking blocks interconnecting intersecting vertical and horizontal cables.
Figure 27:
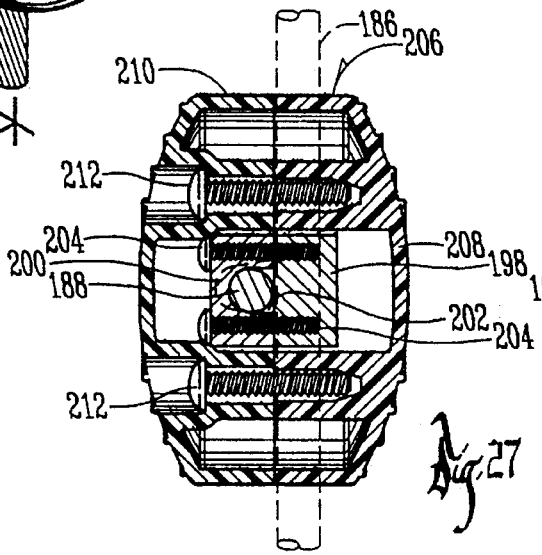
FIG. 27 is a cross sectional view taken along line 27—27 in FIG. 25.
Figure 26:
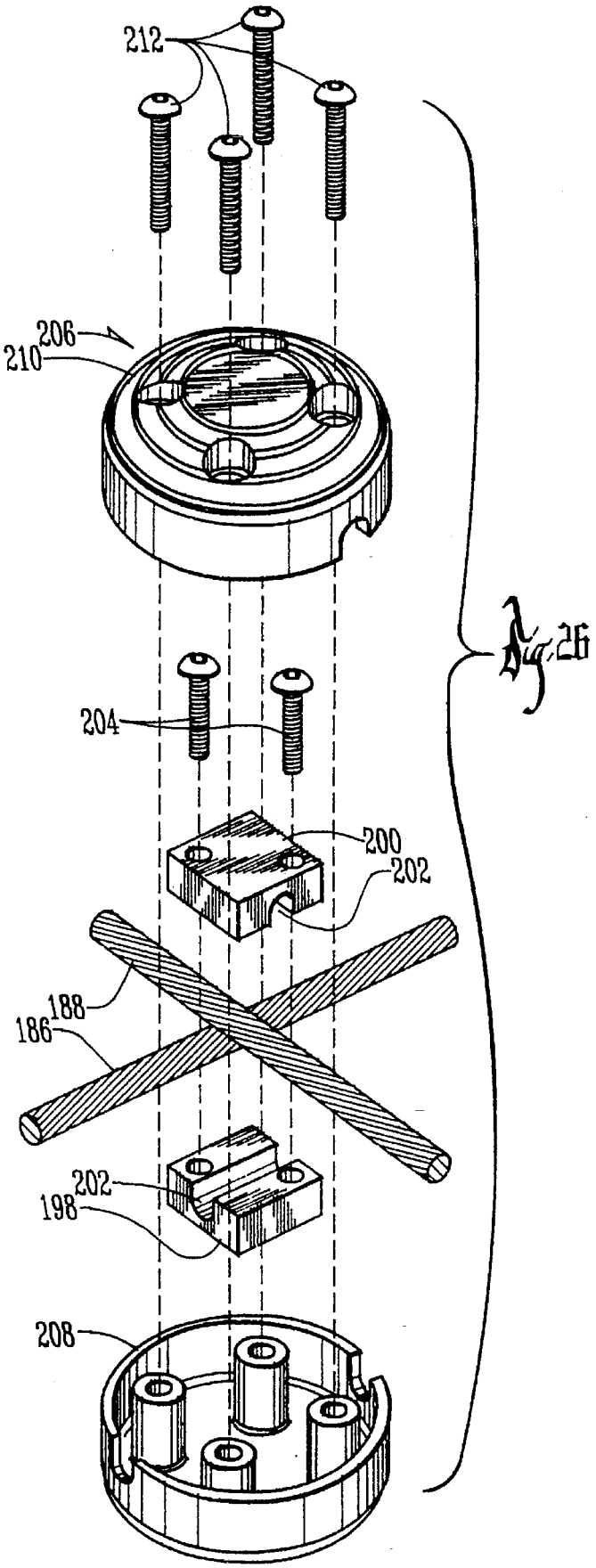
FIG. 26 is an exploded perspective view of thereof.
Figure 28:
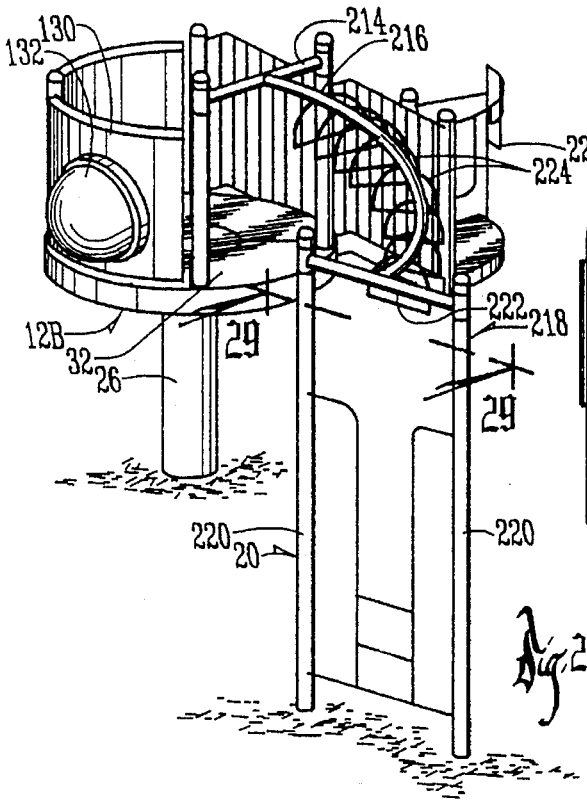
FIG. 28 is a fragmentary perspective view of a hand ring bridge connected to the playground deck.
Figure 29:
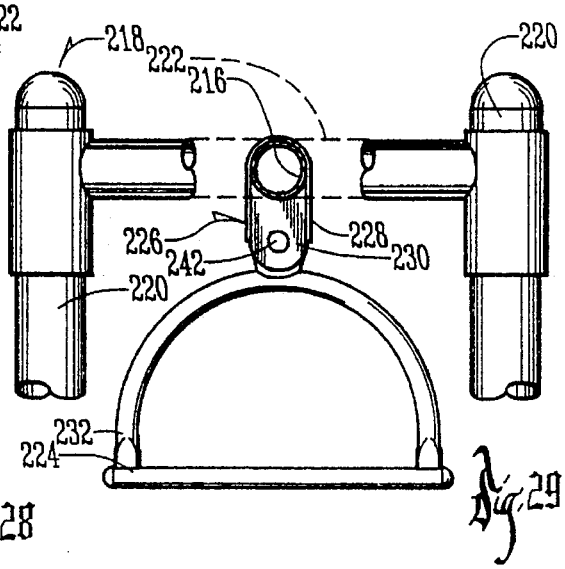
FIG. 29 is a cross sectional view taken along line 29—29 in FIG. 28.
Figure 30:
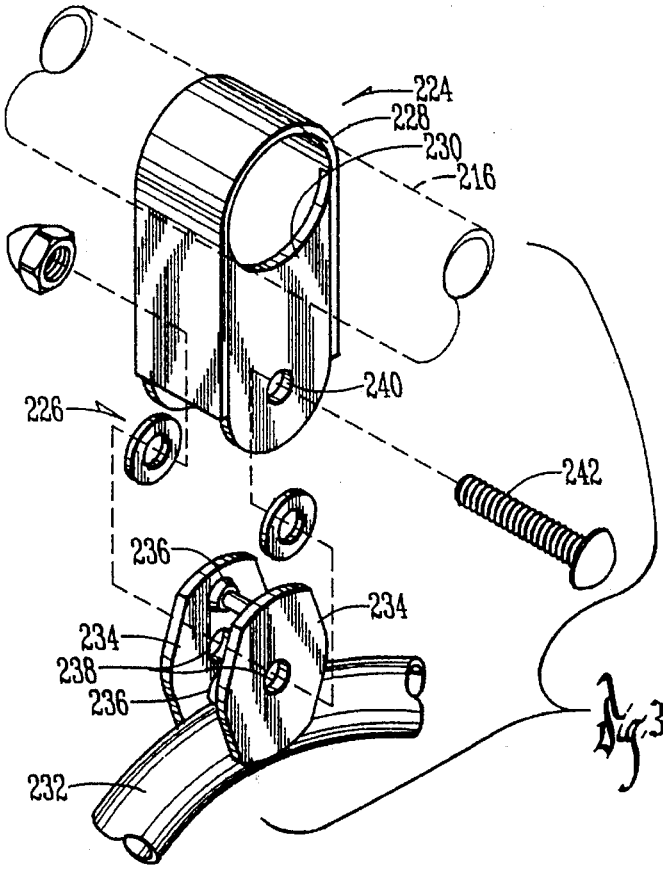
FIG. 30 is an exploded fragmentary perspective view of the hinge and hanger assembly connection of the rings to the overhead support rail.
Figure 31:
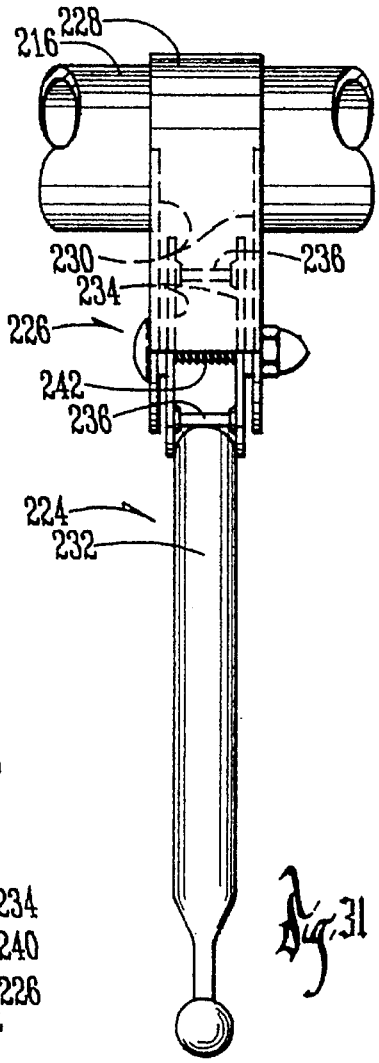
FIG. 31 is an enlarged side elevational view of the ring and its connection to the rail.
Figure 32:
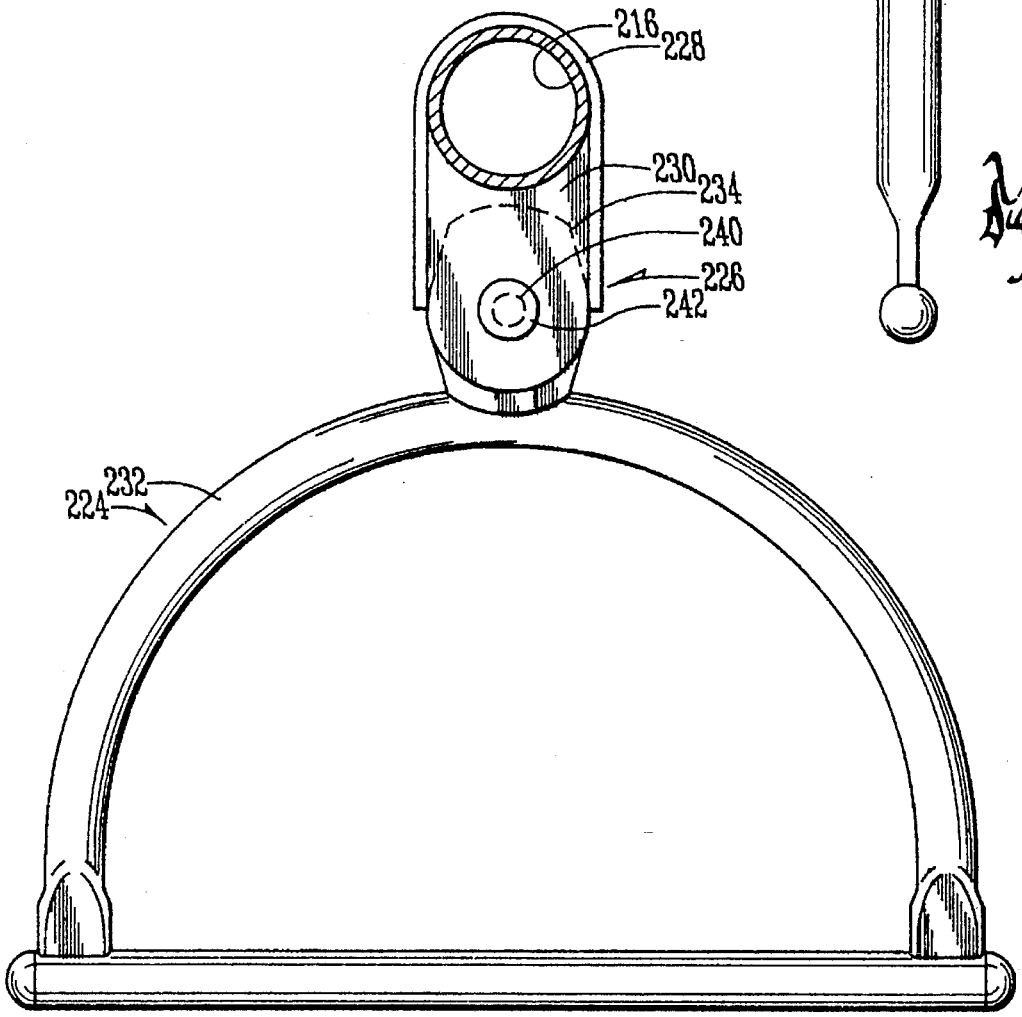
FIG. 32 is an end elevational view of the ring assembly connected to the rail.
Figure 33:
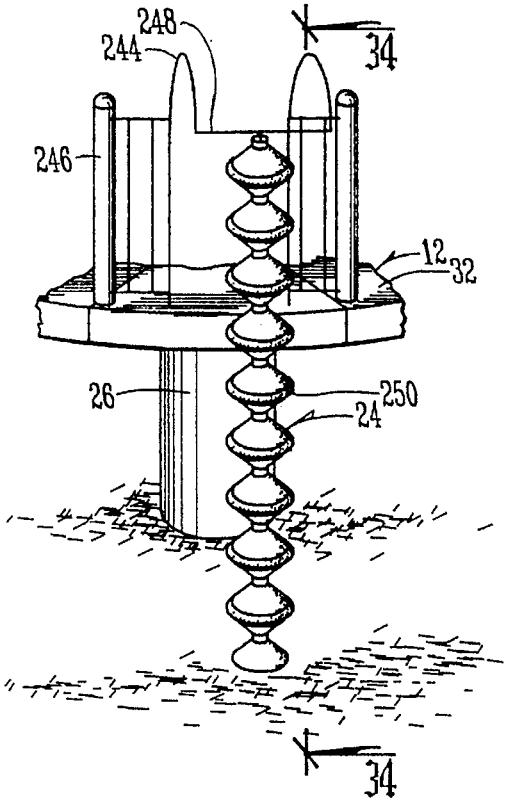
FIG. 33 is a fragmentary perspective view of a bumper ladder on the deck.

The transfer platform 22 for providing access to the playground deck for physically restricted children is best illustrated in FIGS. 20–22 and is shown connected to the deck 12B through steps 116. The transfer platform 22 includes pie shaped sections 166 secured in place by bolts 168 extending through the supporting metal frame 170 into T bolts not shown molded into the section 166. The height of the section 166 is suitably selected for the convenience for the user and is seen to be above the ground level 172 on which the last step 174 is located. An access opening 176 is provided into the transfer platform 22 and is defined by the floor sections 166, and a top rail 178 extending between opposite side members 180. The access opening 176 is further restricted by assist bars 182 which are spaced apart centrally and extend down from the top railing 178 and then outwardly to the side members 180. A lower secondary rail 184 is provided below the top rail 178. The lower rail 184 and the assist bars 182 provide handholds for the user to gain access through the access opening 176.

The web climber 18 is best illustrated in FIGS. 23–27 and is seen to include a grid of vertically extending cables 186 which intersect with horizontal cables 188. The vertical cables 186 are connected at their top ends to a ring 190 bolted onto a panel 192. Panel 192 has an access opening 194 to reach the web climber 18. The lower ends of the vertical cables 186 are connected to a steel tube 196 anchored in the ground.

The vertical cables 186 and horizontal cables 188 are locked to each other at each intersection by a pair of locking blocks 198 and 200 which have elongated channels 202 which are transverse to each other for receiving the cables 188 and 186 respectively. A pair of bolts 204 lock the blocks 198 and 200 together pressing the cable 188 against the cable 186 such that relative movement there between is prevented.

A cylindrical shell 206 encloses the locking blocks 198 and 200 and includes shell half sections 208 and 210 which are locked together by bolts 212. The shell 206 functions as a handhold and footrest for persons climbing on the web climber. The shells give a button pattern appearance throughout the grid. Along the sides of the grid the horizontal cable 188 are dead ended within the shell 206 and are held against being pulled out by the blocking blocks 198 and 200.

The hand ring bridge 20 is illustrated in FIGS. 28–32 and is seen mounted on a deck 12B through a cross bar 214 connected to a post 68. A rail 216 is curved and extends to a free standing standard 218 having side posts 220 interconnected by a top rail 222. The rail 216 includes a series of spaced apart D shaped hand rings 224.

The rail 216 includes a hanger assembly 226 which has a U shaped strap 28 extending over the top of the rail 216 and downwardly along both sides. A pair of end plates 230 engage the bottom side of the rail 216 and are welded to the inside faces of the strap 228. The D ring 224 includes a downwardly facing U shaped member 232 to which a pair of elongated upstanding spaced apart plates 234 are welded and interconnected by bolts 236. A central opening 238 through the plates 234 registers with a hole 240 in plates 230 to receive a bolt 242. It is seen that this arrangement allows pivotal movement only transversely of the rail 216 and thus keeps the hand rings 224 in parallel alignment along the rail 216 so that a person can readily hand walk along the full length of the rail. Pivotal movement in the transverse direction is encouraged but limited to a reasonable degree by the upper ends of the plates 234 engaging the inside faces of the strap 228 of hanger 226.

Figure 34:
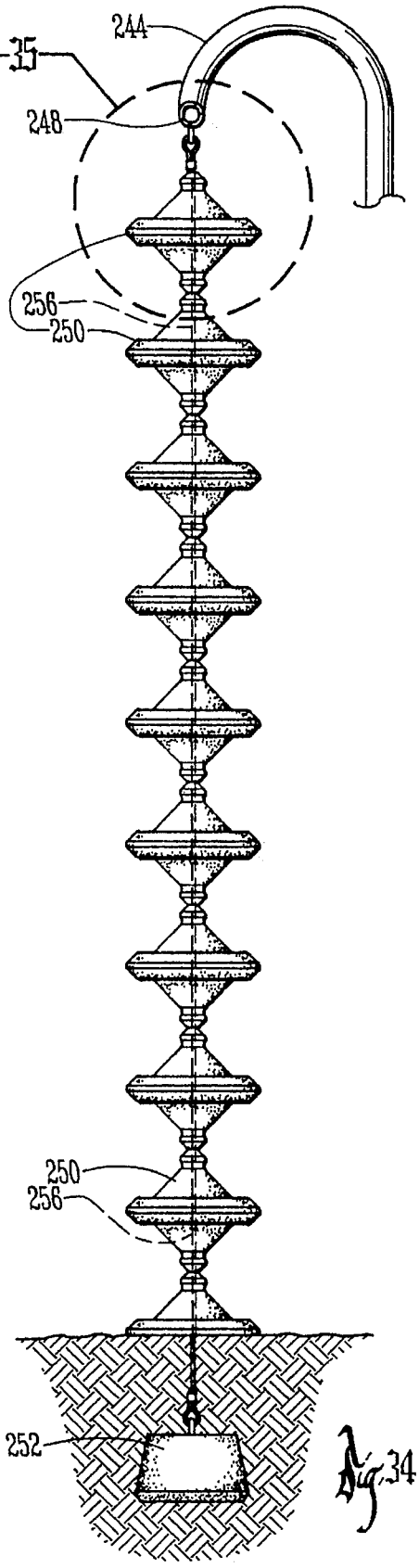
FIG. 34 is a cross sectional fragmentary enlarged view taken along line 34—34 in FIG. 33.
Figure 35:
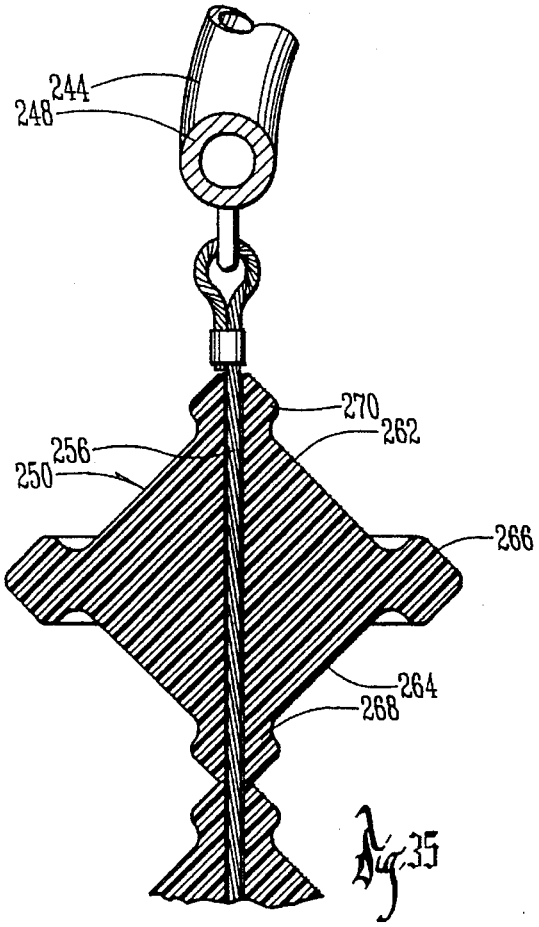
FIG. 35 is an enlarged cross sectional view of a spool as indicated along lines 35—35 in FIG. 34.
Figure 36:
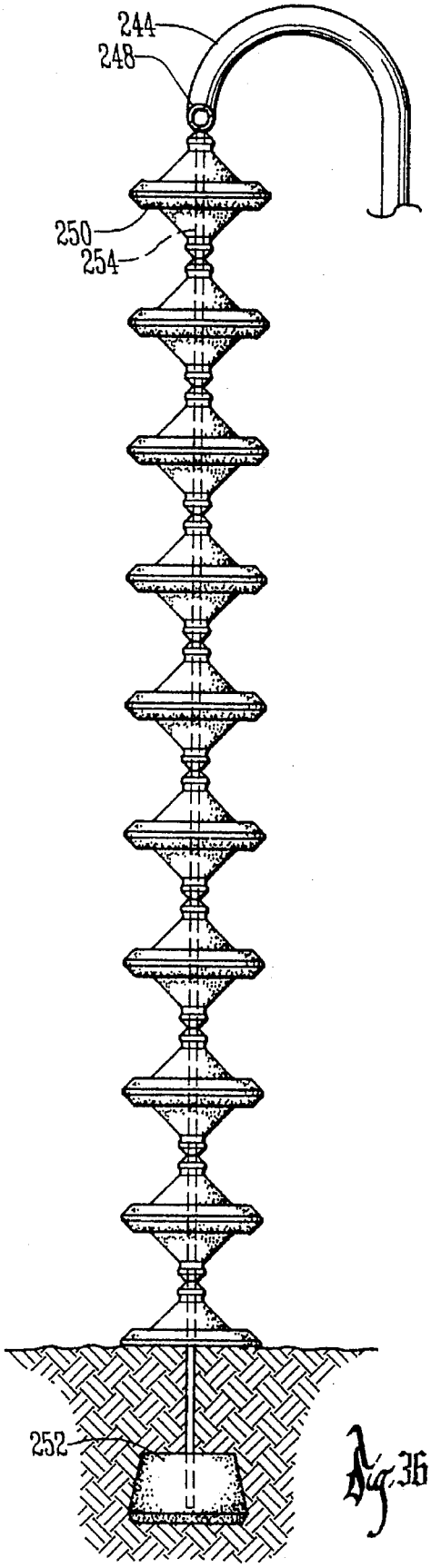
FIG. 36 is a fragmentary elevational view of the spools mounted on a pole.
Figure 37:
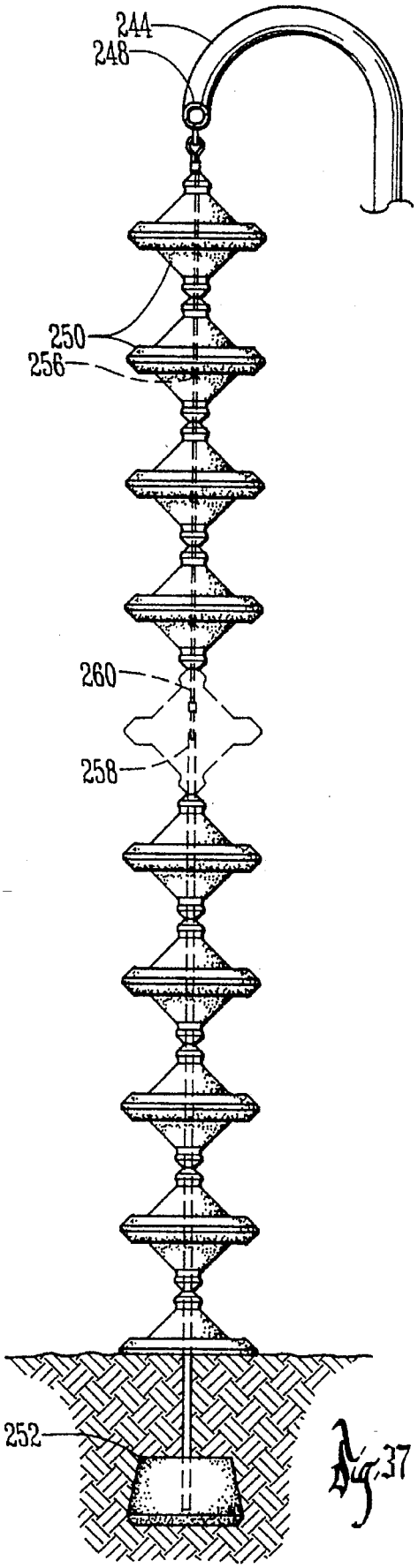
FIG. 37 is a fragmentary elevational view of the spools mounted on a support member including a cable at the top connected to a pole at the bottom.

The bumper ladder 24 is best illustrated in FIGS. 33–37 and includes a support stand 244 mounted on spaced apart vertical members 246. The support stand is U shaped downwardly with the outer end 248 having attached thereto a spool 250 support which extends to a concrete footing 252 in the ground. The spool support may be a pole 254 as seen in FIG. 36 or a cable 256 as seen in FIG. 35. In FIG. 37 a combination of pole 258 at the lower end and cable 260 at the upper end is shown. The cable arrangement of FIG. 34 is the most challenging while the pole of FIG. 36 is the least challenging. The combination as shown in FIG. 37 is of intermediate difficulty.

The spools 250 are symmetrical in appearance with the top and bottom ends being mirror images of each other. The top surfaces 262 slope downwardly and outwardly to meet upwardly and outwardly extending surfaces 264 from the lower end. An annular shoulder 266 is provided at the midsection of this spool at the junction of the surfaces 262 and 264. An annular shoulder 268 is provided at the lower end matching a top end annular shoulder 270. The shoulders 266, 268, and 270 provide handholds and footrests for users of the bumper ladder.

Figure 38:
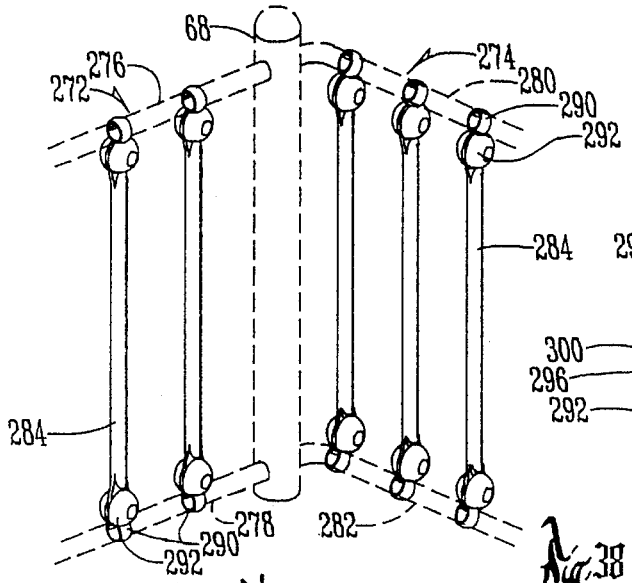
FIG. 38 is a fragmentary perspective view of enclosure panels having vertical rods connected to upper and lower rails through clamp assemblies.
Figure 41:
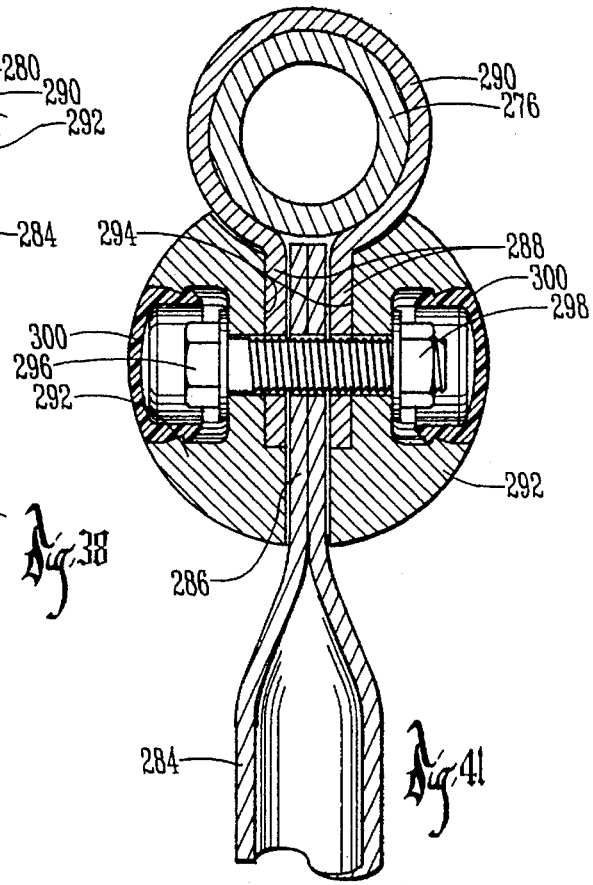
FIG. 41 is a cross sectional view taken along line 41—41 in FIG. 39.
Figure 39:
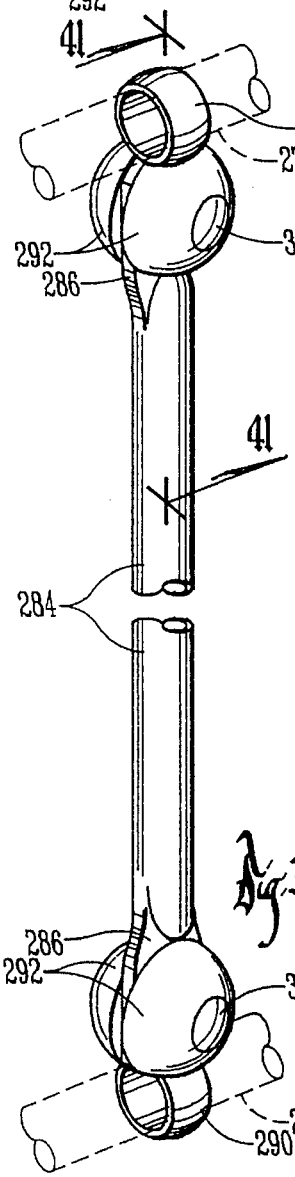
FIG. 39 is a fragmentary enlarged perspective view of a rod connected to the upper and lower rails.
Figure 40:
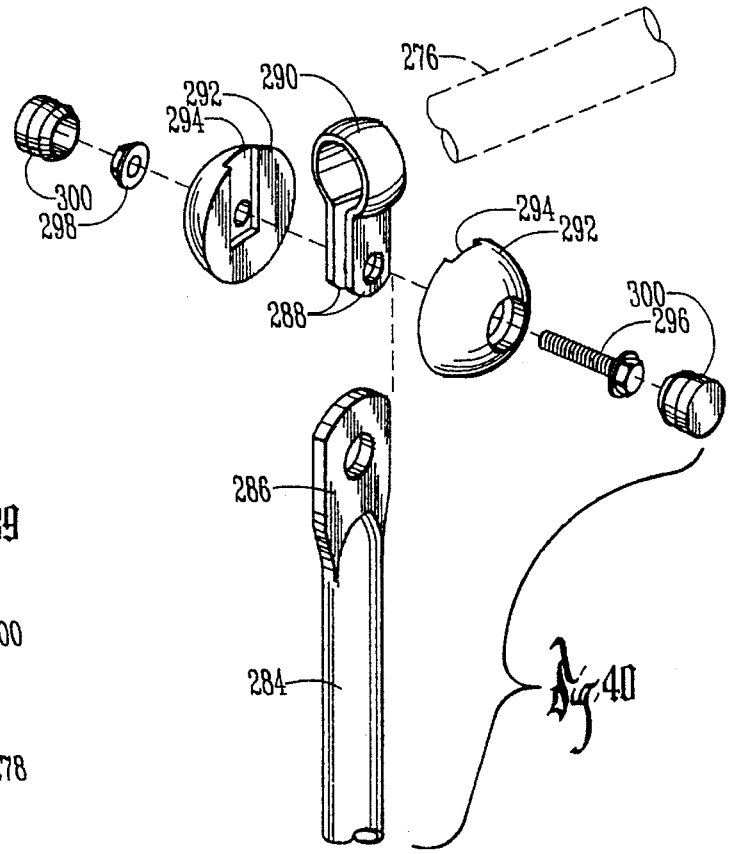
FIG. 40 is an exploded perspective fragmentary view of the upper end of a rod and its clamp assembly connection to an upper rail.

A pair of enclosure panels 272 and 274 are shown in FIG. 38 connected to a post 68. The panel 272 is connected through an upper rail 276 and a bottom rail 278. The panel 274 is connected to the post 68 through an upper rail 280 and a bottom rail 282. A series of vertical rod members 284 interconnect the upper and lower rails.

It is seen that each rod 284 has opposite ends 286 which are flattened and received between a pair of legs 288 on a hanger 290 extending over a rail 276. A pair of semi-spherical half sections 292 have recesses 294 in their inside faces which receive the hanger 290 and its legs 288 such that pressure is applied when a bolt 296 extending through the half sections 292 and legs 288 clamps the assemblage tight about the rail 276. The semi-spherical half sections 292 when assembled give the appearance of a ball at the top and bottom ends of the rods 284. The rods 284 may pivot as is necessary for alignment purposes in such installations as on stairs as seen in the enclosure panel 274. The bolt 296 includes a nut 298 and caps 300 conceal the bolt and nut from view and being tampered with.

I claim:

1. A playground deck comprising, a support frame, said support frame including a pedestal centrally positioned under said deck, said frame including a connecting means extending between the outer ends of adjacent arms to provide a unitary support frame, a plurality of pie shaped deck sections on said frame in side by side relationship forming said deck, said frame including a plurality of support arms radiating outwardly from said pedestal for supporting said deck sections above the ground, at least one of said pie sections including an outer end portion connected to said pie section through said connecting means, and said one pie section having a straight outer end surface and said end portion having an outer rounded surface such that a round in shape platform is provided when all pie sections have end portions.

2. The playground deck of claim 1 wherein said deck sections each comprise a plastic pie shaped shell having an interior chamber filled with plastic foam material.

3. The playground deck of claim 1 wherein said pedestal has a top end which includes a plurality of brackets spaced apart around its outer periphery to which inner ends of said arms are connected.

4. The playground deck of claim 3 and a ring is concentrically positioned in the top end of said pedestal and said arms each include a projection that extends over the top end of said pedestal and is connected to said ring making said support frame a composite structure.

5. The playground deck of claim 1 wherein each of said arms include on both sides, upper and lower, longitudinally extending support ledges engaging said pie shaped deck sections on opposite sides thereof.

6. The playground deck of claim 5 wherein said deck sections each include on opposite sides intermediate its top and bottom sides a longitudinally extending downwardly facing shoulder engaging said upper support ledge.

7. The playground deck of claim 6 wherein said arms include a lower longitudinal edge which extends upwardly and outwardly from said pedestal, and said lower ledge is connected to said arm along said lower edge.

8. The playground deck of claim 7 and said pie sections have top and bottom sides with said bottom side extending upwardly and outwardly from said pedestal towards said top side which extends horizontally.

9. The playground deck of claim 1 wherein each arm has an outer free end which includes a post holder and a post is received therein to provide a plurality of spaced apart upstanding posts around the outer periphery of said platform.

10. The playground deck of claim 1 wherein each arm includes at its outer end a bracket having oppositely extending wing sections to which said connecting means is connected.

11. The playground deck of claim 10 and a post holder is provided on each of said arms at its outer end between the outer end of the arm and said bracket.

12. The playground deck of claim 1 wherein said connecting means is a L shaped plate having vertical and horizontal leg portions, said outer end portion of said pie section includes an L shaped plate with vertical and horizontal leg portions, and fastening means interconnects the horizontal leg portions of said first and second mentioned L shaped plates.

13. The playground deck of claim 12 and each of said pie sections include a top surface which forms a ledge at its outer end extending outwardly over an inwardly off set vertical end wall, said first and second L shaped brackets being positioned under said ledge such that said outer end portion engages said ledge to form a substantially continuous deck surface.

14. The playground deck of claim 13 and said first L shaped bracket includes a diagonally outwardly extending portion extending between the vertical and horizontal legs for forming a space between the inwardly off set vertical end wall and said first L shaped bracket, and said fastening means extends into said space.

15. The playground deck of claim 14 and a second fastening means directly connects said first L shaped plate to the outer end of said pie section to make said pie section unitary with said support frame.

16. The playground deck of claim 1 and a bridge or stairs is connected through said connecting means to one of said pie sections at its outer end.

17. The playground deck of claim 16 wherein said connecting means is a L shaped plate having vertical and horizontal leg portions, said bridge or stairs includes an L shaped plate with vertical and horizontal leg portions and fastening means interconnects the horizontal leg portion of said connecting means L shaped plate and the horizontal leg portion of said bridge or stairs L shaped plate.

18. The playground deck of claim 1 wherein said deck includes at least one upstanding hollow post at the outer peripheral edge and a railing structure is connected to said post, said railing structure including upper and lower tubular members having end portions received in openings in said post, and a lock means in said post rigidly connecting said railing structure to said post.

19. The playground deck of claim 18 wherein said lock means includes a pair of lock elements with one lock element being above said one tubular member and the other lock element being below said lower tubular member and adjustment rod means connecting said lock elements for drawing said lock elements against said tubular members.

20. The playground deck of claim 19 wherein said lock elements and the interior of said hollow post have complimentary shapes.

21. The playground deck of claim 20 wherein said complimentary shapes are defined as being round.

22. The playground deck of claim 21 and a stop means is provided on said lock elements for engaging said tubular members to prevent rotation of said lock elements when being drawn against said tubular members.

23. The playground deck of claim 19 and said one upper lock element and said upper tubular member each have aligned openings in which a pin element is received to limit withdrawal of said upper tubular member from the inside of said post.

24. The playground deck of claim 19 and a removable cap is provided on the top of said post to give access to said adjustment means in the interior of said post for operation of said lock means.

25. A playground deck comprising, a support frame, and a ladder having upper and lower ends connected to said deck at the upper end of the ladder and to the ground at the lower end, and said ladder includes a series of spools mounted in end to end relationship to provide steps between the upper and lower ends.

26. The playground deck of claim 25 wherein said ladder includes a pole extending axially through each of said spools.

27. The playground deck of claim 25 wherein said ladder includes a cable extending axially through each of said spools.

28. The playground deck of claim 25 wherein said ladder includes a length of cable at its upper end connected to a pole at its lower end extending axially through said spools with said pole being rigidly secured to the ground at its lower end and said ladder being flexible throughout the length of said cable.

29. The playground deck claim of 25 wherein said ladder is connected to said deck through a support stand which extends upwardly from said deck, then outwardly from said deck and then downwardly to said ladder.

30. The playground deck of claim 25 wherein said spools each include an axial opening along its length between its upper and lower end, its upper end slopes downwardly and outwardly toward its midsection and then inwardly and downwardly towards its lower end.

31. The playground deck of claim 30 and said spools each include enlarged circumferential shoulders at the top and bottom ends and midsection to provide handholds and footrests.

* * * * *